US005147975A

United States Patent [19]

Munach et al.

[11] Patent Number: 5,147,975

[45] Date of Patent: Sep. 15, 1992

[54] REMOTELY SETTABLE, MULTI-OUTPUT, ELECTRONIC TIME FUZE AND METHOD OF OPERATION

[75] Inventors: Arnold S. Munach, Rockville; Alvin J. Auerbach, Silver Spring, both of Md.

[73] Assignee: The United State of America as represented by the Secretary of the Navy, Washington, D.C.

[21] Appl. No.: 255,909

[22] Filed: Apr. 20, 1981

[51] Int. Cl.[5] ..... F42C 15/40

[52] U.S. Cl. ..... 102/264; 102/254; 102/363

[58] Field of Search ..... 102/264, 262, 363, 254, 102/255

[56] References Cited

U.S. PATENT DOCUMENTS

| | | | |
|---|---|---|---|
| 2,972,946 | 2/1961 | Poulter | 102/262 |
| 3,940,443 | 2/1976 | Glass | 102/363 |
| 4,273,048 | 6/1981 | Aley et al. | 102/363 |

OTHER PUBLICATIONS

*Oak Leaf*; "White Oak Designs SLUFAE Fuze", vol. 33, No. 16, Aug. 5, 1977.

Dennis, James A.; "SLUFAE: Long-Range Minefield Breaching System Tested"; *ARMY R&D*; vol. 17, May-Jun. 1976.

*Primary Examiner*—Charles T. Jordan

*Attorney, Agent, or Firm*—Kenneth E. Walden

[57] ABSTRACT

A single ordnance fuze comprising electronic means to initiate three separate detonation outputs.

The first detonation output being used for round parachute deployment and fuze probe cover release. Simultaneously a mechanical timer is started which delays deployment of a six (6) foot stand-off probe until the parachute has slowed the round almost to its terminal speed.

The second detonation is initiated by depression and closure of a switch in the tip of the probe. This detonation initiates deployment a pair of detonators from the round that serve to ignite fuel that is later distributed to a prearranged site by a third explosive charge.

An automatic electronic timer of short duration is also initiated by the closure of the probe switch.

The third detonation is initiated by the automatic timer.

The third detonation initiates a burster charge for fuel dissemination, thus completing all three of the fuze explosive functions.

11 Claims, 5 Drawing Sheets

REMOTELY SETTABLE, MULTI-OUTPUT, ELECTRONIC TIME FUZE AND METHOD OF OPERATION

CROSS REFERENCE TO RELATED APPLICATION

This application is a related to application Ser. No. 216,400 filed on Dec. 15, 1980.

BACKGROUND AND OBJECTS OF THE INVENTION

The invention disclosed herein relates to electronically charged fuzes capable of multiple explosive outputs.

Conventional (nonnuclear) weapons with high-explosive warheads generally employ solid explosive fillers which are initiated from within the warhead by a fuze which is a integral part of the warhead. The detonation takes place at a specific position or time, either above, on, or in the target. Usually, the small variations from a desired position or time are not crucial to effectiveness, nor are they factors in the detonation of the high explosives. Large variations may produce reduced effectiveness but still do not produce duds.

The advent of fuel-air explosive (FAE) warheads has challenged ordnance designers to create fuzes which produce more than one explosive output to control warhead-to-target approach speed, orientation, and height-above target for proper fuel dissemination and aerosol cloud formation. Additionally, a detonation shock must be provided to the resultant fuel-air cloud at the correct time and in the proper position to cause it to detonate; otherwise, the cloud will simply deflagrate or fail to iginite, both of which outcomes are ineffectual.

Accordingly, it is the primary object of this invention to provide an ordnance fuze for a rocket-propelled fuel-air explosive round, which provides three consecutive separate detonation outputs. The first is during the round's flight at an accurate and remotely presettable time (setting is accomplished when the round is in its launcher) to control the round's range; the second is when the warhead of the launched round is six feet from striking its target terrain; and the third is at a precise short time interval after the second. This will replace three separate and complexly interconnected fuzes known on the prior art. The prior art method of accomplishing the objective of providing three outputs necessitates three separate ordnance fuzes for the round which are interconnected on the round by mechanical and explosive means. The first fuze, the FMU-83/B mechanical time fuze, provides an explosive output at a variable presettable time. In order to accomplish this, the fuze timer must be set by hand before the round is installed in its launch tube because there is no fuze access with the round in its tube. A change in mission time necessitates removal of the round from the tube to reset the timer. The FMU-83/B requires an arming wire to secure the fuze from timing before launch. At launch, the fuze disengages from the wire. Routing of the wire through the launcher and, attachment to the launcher is clumsy and unreliable. The functioning of this fuze, in addition to its primary purpose of explosively initiating the deployment of a parachute, causes a cover to be explosively expelled from the second fuze (an FMU-95/B bomb fuze) and provides a piezoelectrically generated electrical input to that fuze, and releases the catch on the third fuze to allow it to move into explosive transfer alignment with the output charge of the second fuze. The second fuze then operates to deploy a four-foot extendible probe, after a mechanically timed delay, to provide firing standoff between the round and the target terrain. At terrain contact, the probe tip causes a stab detonator to fire and stress a piezoelectric crystal which, in turn, generates voltage to fire an electric detonator. The output of the electric detonator is fed to the third fuzing device, which initiates expulsion of certain detonating devices from the round and, by means of a pyrotechnic delay element in its explosive train, also initiates the round's main charge at a short and imprecise time interval later for fuel dissemination and cloud formation.

The disadvantages of the prior art fuzes are as follows:

a. The first fuze setting cannot be changed once the round is in the launcher, significantly curtailing system flexibility.

b. Three fuzes are employed, which is expensive, due to redundancy of housings, arming devices, and associated explosive components.

c. An external interconnection mechanical and explosive network must be provided the three fuzes.

d. An arming wire must be provided to initiate the first fuze. This requires in-the-field attachment to the launcher, which increases launch preparation time and may not always be reliably achieved under combat-stress conditions.

e. The extendible probe provides only four feet of standoff where six feet are required to obtain optimum cloud thickness.

f. The pyrotechnic delay for fuel dissemination varies extensively with temperature, adversely affecting the round's performance.

g. The second fuze has a two-minute delay pyrotechnic self-destruct mechanism which operates in the event the fuze does not fire at terrain impact. This device is expensive and unreliable.

Therefore, with the background of the invention set forth above, some of the objects, in addition to the primary object set forth above are as follows:

It is one additional object of the invention to provide an electronically chargeable fuze that can be remotely set or reset in a very short period of time.

It is also one object of the invention to provide a fuze with a rotatable rotor where the rotor has at least three detonator ports, with a detonator positioned in each port and where each detonator is oriented to point in a direction different from each adjacent detonator.

It is another object of this invention to provide a single electronically chargeable fuze that has the minimum number of components necessary to accomplish three explosive outputs.

It is one additional object of this invention to provide a fuze that is capable of close tolerance timing for the first and third detonations.

It is a still further object of the invention to provide a fuze with a simple, inexpensive redundant inertia switch electrically parallel to the probe switch that initiates the second and third detonations despite the failure of the probe to function properly, in order to detonate otherwise unexploded explosives and thus preclude enemy usage of such material against our own forces.

It is another object of this invention to replace a pyrotechnic self-destruct mechanism with an inertia switch which is electrically in parallel with the probe switch so that if the probe switch fails to close, the inertia switch will function on round impact thus causing the remaining explosives (cloud detonators and burster charge) to detonate and thereby eliminate residual or undetonated explosives in the event of a dud round.

It is another object of this invention to provide a fuze with electrical inertia switch means to provide an automatic clean up or self destruction of residual explosives.

SUMMARY OF THE INVENTION

The electronic time fuze and the method of operating the electronic time fuze of this invention consists of a chargeable electronic module that transmits electrical energy into three separate explosive trains by a novel three-detonator rotor. The rotor mechanism is disclosed and claimed in U.S. patent application Ser. No. 216,400 filed on Dec. 15, 1980.

The first of the three explosive trains initiates parachute deployment and subsequent automatic opening of the hatch where the probe is stored.

Simultaneously a mechanical timer is started that delays the deployment of the extendible standoff probe. When the probe makes contact with the target terrain, closure of a switch in the probe tip initiates explosive expulsion of two cloud detonators.

The third detonation is initiated by an electronic timer that initiates the third detonator at a short, precise interval after the probe makes contact with the terrain.

A summary of the method of operation of the fuze follows. The launcher first delivers charging energy to each round's XM750 fuze in a timed sequence and then delivers energy to each motor ignitor, also in sequence. The motor burns for 0.3 second, accelerating the round to 127 m/s. Fuze arming is achieved prior to the minimum settable parachute deployment time of 1 second. At the set time, which may be programmed to vary from 1.0 to 12.0 seconds, the fuze explosively initiates parachute deployment. Simultaneously, a mechanical timer is started which delays the deployment of a six-foot extendible standoff probe until the parachute has slowed the round almost to its terminal speed. At probe contact with the target terrain, the round is oriented nearly vertically and its speed has been reduced to 30 m/s. Closure of a switch in the probe's tip initiates explosive expulsion of the two cloud detonators located on the aft face of the warhead canister. The two cloud detonators, which contain safety and arming devices, fly outward from the warhead. The warhead burster charge is initiated shortly thereafter by the third fuze detonation, after the cloud detonators have flown clear of the warhead firing. The fuel in the canister, under the impetus of the detonating burster charge, ruptures the canister and rapidly mixes with the surrounding air to form a fuel-air aerosol cloud. Then, a very short time after ejection from the warhead, the two cloud detonators fire and detonate the cloud.

DESCRIPTION OF THE PREFERRED EMBODIMENT

General Description

Figure 1:
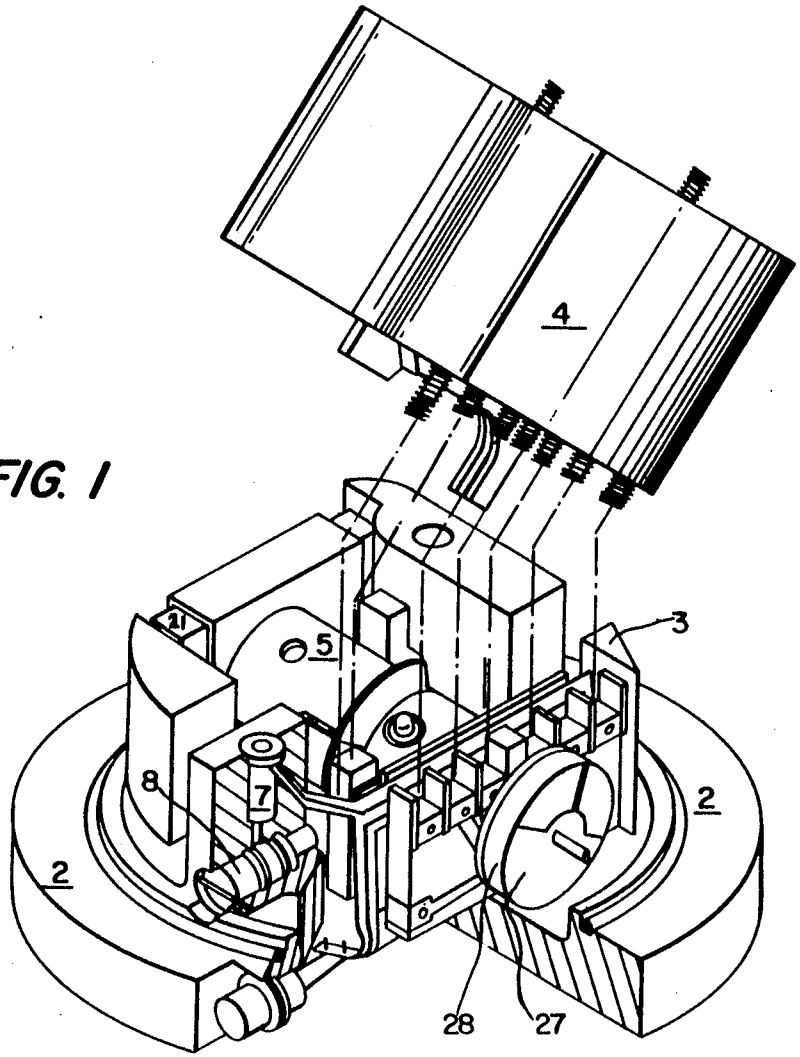
FIG. 1 is a perspective view of the electronic fuze safing and arming device of this invention and associated electronics module.

The Electronic Fuze of the invention is designed as the fuze for the Surface Launched Unit Fuel-Air Explosive Mine Neutralization System rocket. It is electrically charged at a variable pre-set time before round launch and afterward initiates (a) deployment of the round's parachute, (b) warhead launch of the fuel-air cloud detonators, and (c) detonation of the warhead burster to dispense the fuel in the canister. Parachute deployment time controls the round's range and is preselectable. Launching of the cloud detonators occurs when either an extendible probe from the fuze or the round itself strikes the terrain. Warhead burster detonation then follows a short time later.

In general, the fuze 10 is mounted to the front of the warhead 11. Attached to the fuze are a three-pin charging connector whose shield is grounded to the fuze, and two mild detonating fuse cords 12 and 13. One cord 12 contains 10 grain per foot HNS explosive and leads to the parachute deployment mechanism. The other cord 13 contains 5 grain per foot HNS and leads to the cloud detonators in the canister fairing. The parachute deployment time after launch is determined by the launcher programmer and varies from 1 to 12 seconds. The presence of a properly connected fuze on a round is checked by before launch by the programmer briefly and automatically by putting a small negative polarity current through the fuze at approximately 4 volts and detecting this current. The fuze is charged at a preset variable time (0 to 11 seconds) before launch with positive polarity 24.5 volts. This starts the fuze's fixed 12-second electronic timer. Subsequent rocket launching of the round causes the fuze safety and arming mechanism to arm the three explosive trains to the parachute 24B, 14, 12, cloud detonators 24C, 15, 13, and burster 24A, 16, within 0.8 second nominal. After 12 seconds have elapsed from the introduction of charging energy, the first explosive train 24B, 14, 12 initiates parachute deployment. Simultaneously, it unlocks a mechanical timer 17 which deploys an extendible standoff probe after several seconds, when the parachute has slowed the round to terminal speed. Probe 19 deployment at the slow terminal round speed prevents aerodynamic overloading and breakage of the probe. At target impact, a switch located in the probe tip closes, causing the second explosive train 24C, 15, 13 to the cloud detonators to fire, thus launching these devices from the round. A precise, short time interval later, the third explosive train 24A, 16 fires, initiating the canister burster charge 16 and the dispensing of the fuel to form the fuel-air aerosol cloud. The cloud detonators then detonate the cloud at a pyrotechnically delayed short time after burster firing. Two inertia switches, positioned in the fuze's electronics module so as to be omnidirectionally sensitive, provide a backup firing mode electrically in parallel to the probe switch, in the event of a probe failure, so as to cause destruction of the cloud detonators and burster charge.

Explosive Components

The fuze has several explosive components related to arming and function operations. Arming requires that a BBU-24/B explosive actuator 7 (FIG. 1) be electrically initiated while the rotor 5 is turning so that the gas pressure it generates will move a piston and clear the rotor 5 to continue turning. In order to initiate the external 10 grain/foot mild detonating fuse cord 12 in FIG. 2, for parachute deployment and probe cover opening 18, a Mk 96 Mod 0 detonator in the rotor 5 is electrically initiated. Its output initiates a transfer lead 14, which is a threaded plug in the fuze wall containing a short length of 10 grain/foot mild detonating fuse cord 12 and terminating in a 150 milligram charge. The transfer lead side-initiates the external cord which is held in place under a probe cover/fuse cord retainer bar 37. Initiation of the external 5 grain/foot cord 13 to the cloud detonator packages, secured under retainer bar 38 is accomplished in an identical manner on the opposite side of the fuze via transfer lead 15. Burster initiation is accomplished by a third Mk 96 detonator in the same rotor 5 firing directly aft into a Mk 8 Mod 0 lead 16 in the fuze base 39. This in turn fires into the burster initiating lead in the warhead. The burster, not shown, is directly behind lead 16. The probe 19 is stored in probe storage unit 20.

In FIG. 1, a perspective view, the rotor 5 is mounted on the base 2. The rotor is controlled in its rotation by setback weight 21. The explosive actuator 7 and actuator piston 8 are mounted on a part of the base assembly.

Figure 3:
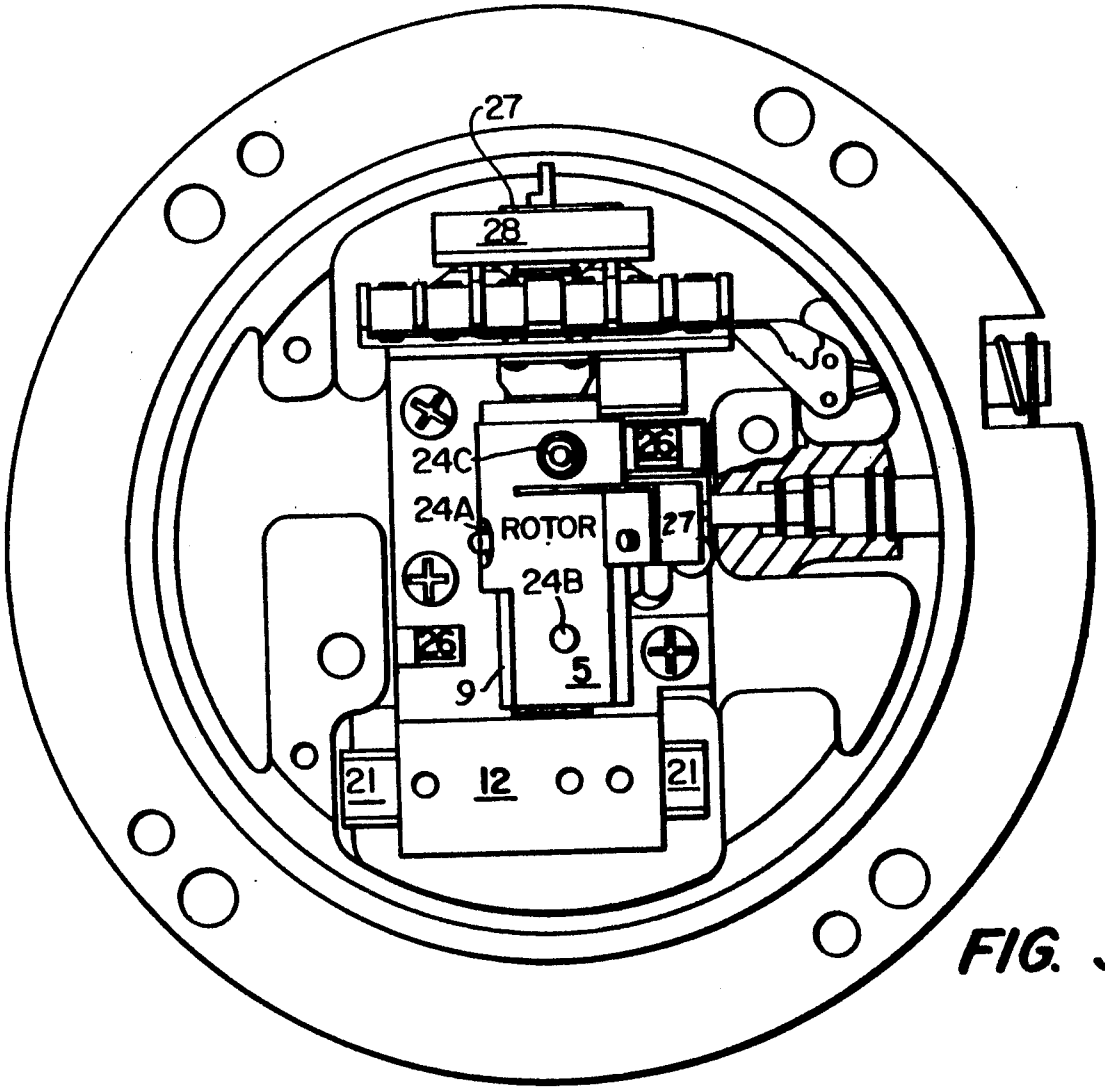
FIG. 3 is a cross section sectional view taken along line 3—3 of FIG. 2.

In FIG. 3, a cross sectional view, the rotor 5 is unbalanced about its pivots by means of a flat 9 on one side and a protruding lobe 27 on the other side.

Figure 2:
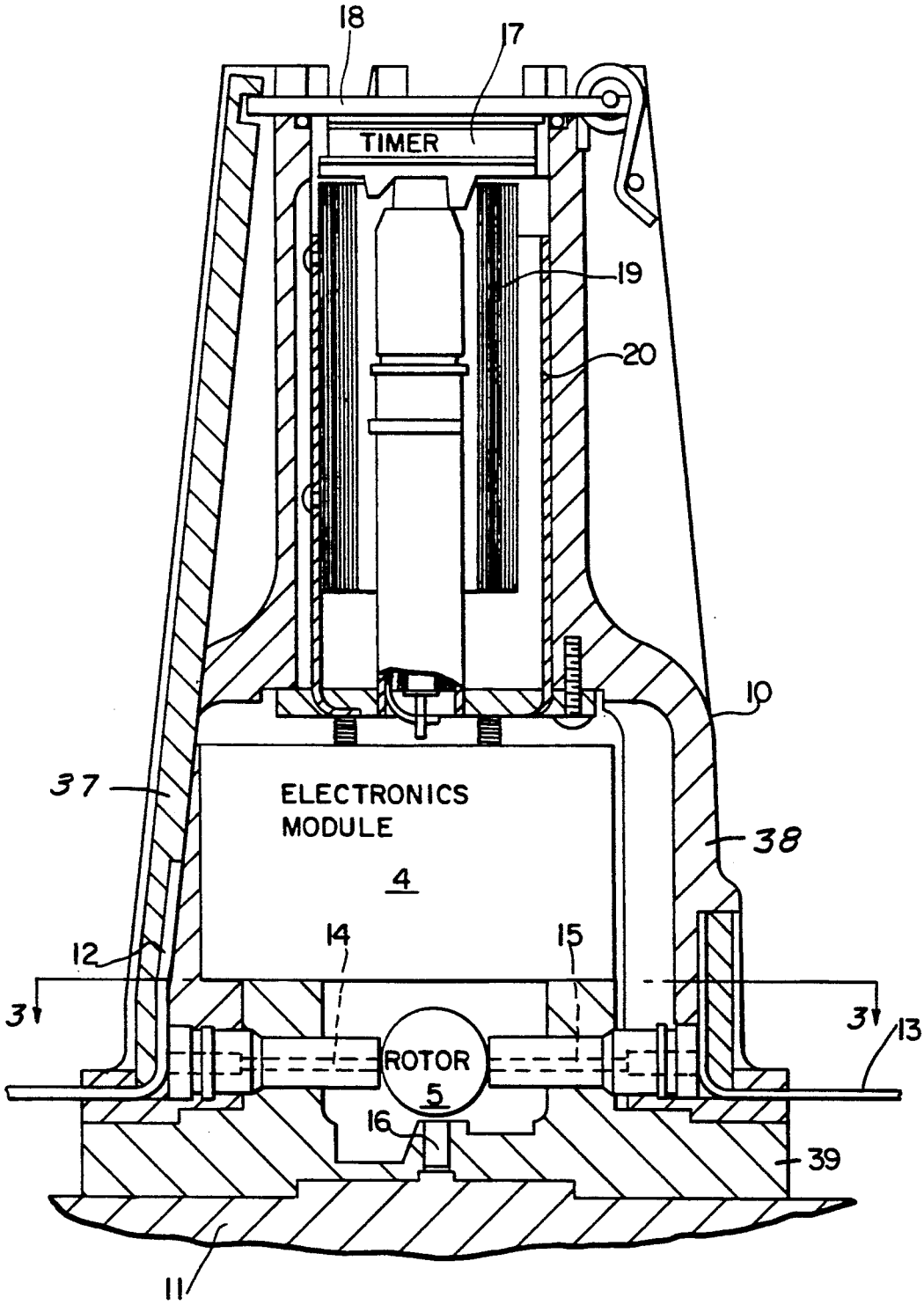
FIG. 2 is a partially cutaway frontal view of the fuze of this invention.

The rotor, as shown, has three detonator parts whose axes intersect the longitudinal axis of the rotor at 90° but are not coplanar. FIG. 3 shows a longitudinal view of the rotor in the safe position. Detonators 24C and 24B are shown in approximate end view, wherein the electrical input button contact is visible in 24C and the explosive output end of 24B is visible. The axis of detonators 24C and 24B are parallel but the direction that the output end of detonator 24B faces is 180° from that of 24C. Detonator 24A lies between detonators 24C and 24B and its button contact is shown in side view in FIG. 3. FIG. 2 shows the rotor in end view. The longitudinal axes of explosive leads 14, 16 and 15 are colinear with the axis of detonators 24B, 24C and 24A respectively when the rotor has turned to the armed position. The output end of each detonator faces the input end or inboard face of each lead. This arrangement of adjacent detonators permits their close spacing in a small rotor without the likelihood of sympathetically detonating a detonator when its adjacent detonator is fired thus allowing for intentionally firing the detonators nonsimultaneously.

The safe/arm indicator is illustrated as 27 the safe arm indicator is mounted on the wheel 28.

The setback weight 21 holds the rotor locked in the safe position and is supported by two parallel springs.

The rotor 5 is fitted with three detonators 24*a, b, c* arranged in a novel design as best disclosed in U.S. application for patent Ser. No. 216,400 filed on Dec. 15, 1980.

Figure 4:
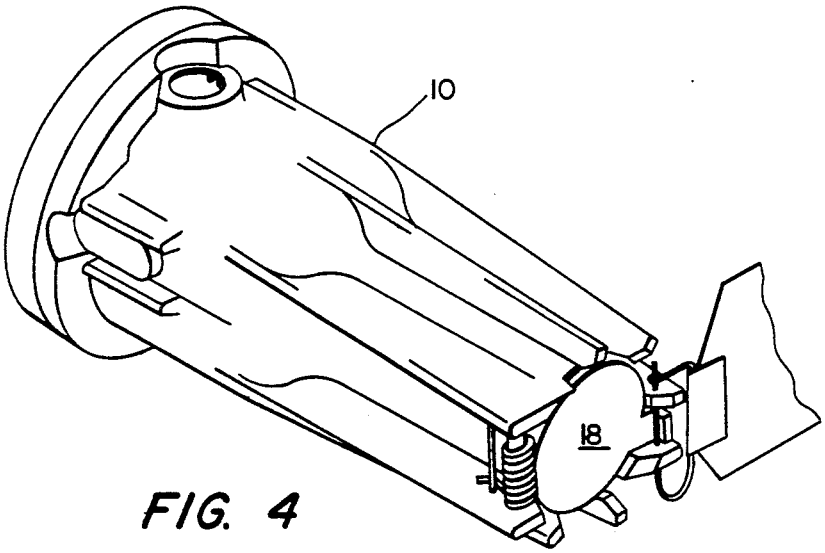
FIG. 4 is a perspective view of the fuze of the invention viewed from the top of the fuze.

In FIG. 4 the fuze 10 is bolted to the warhead 11. The probe cover 18 is illustrated in a closed position.

Figure 5:
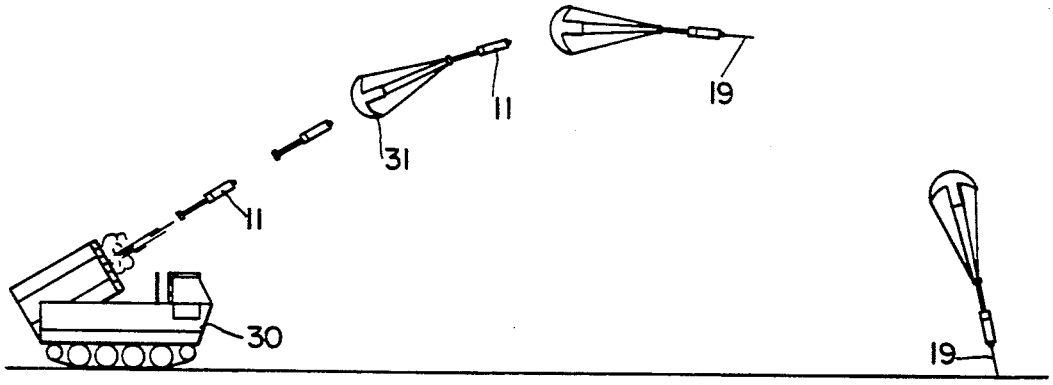
FIG. 5 is a pictorial view illustrating the operational sequence of the invention.

In FIG. 5 the round operational sequence is illustrated. The vehicle 30 launches the round 11. At a predetermined time the parachute 31 opens to slow the round. At a short, precise interval of several subsequent seconds, the probe 19 is deployed.

Figure 6:
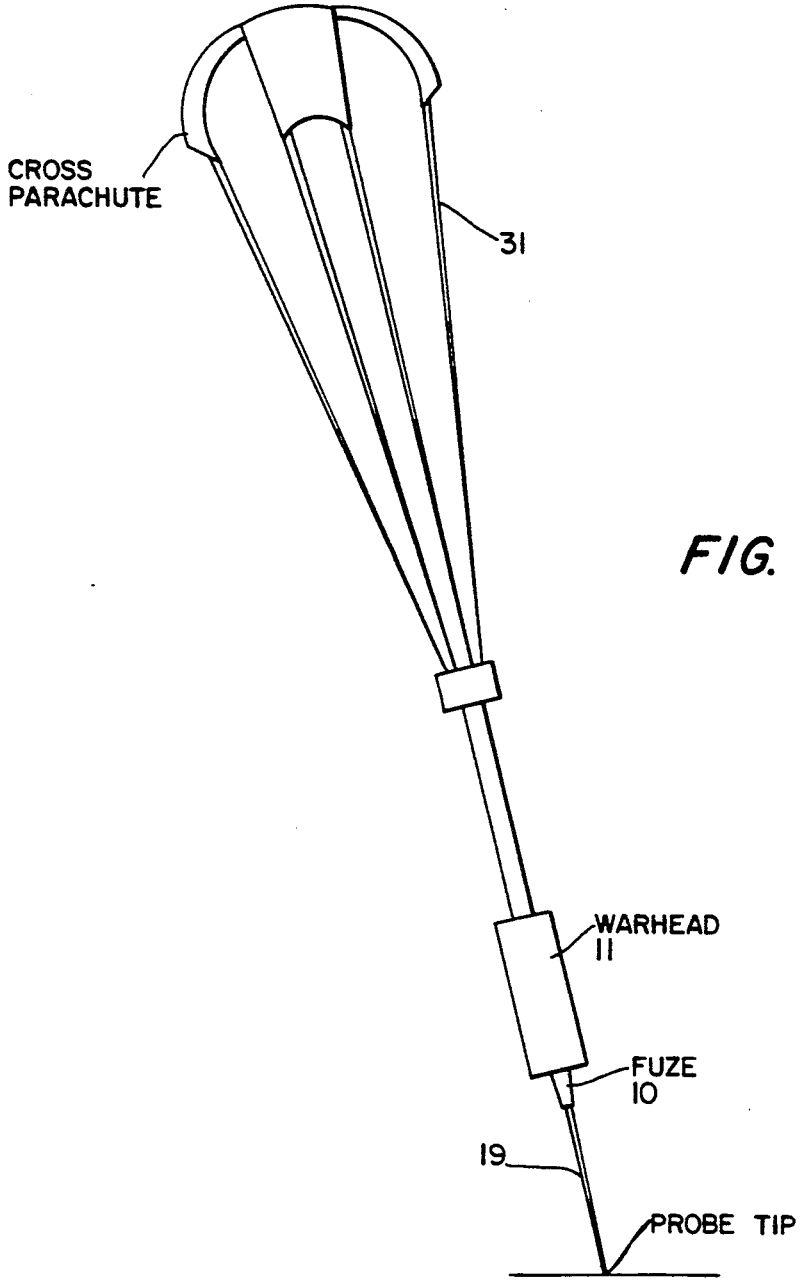
FIG. 6 is an isometric view of a round with probe extended approaching the target.

In FIG. 6 illustrates the extended probe 19 just prior to contact with the terrain.

Figure 7:
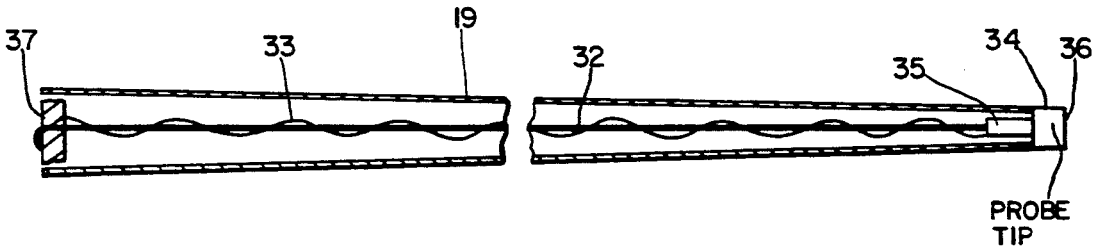
FIG. 7 is a cutaway side view of the extended probe.

In FIG. 7 illustrates taut braided cord 32 with slack probe switch circuit wire 33 helically intertwined. The length of probe 19 is controlled by the length of cord, 32. The impact switch 36 is located in probe tip 34. The cord 32 pays off of bobbin 35. The base of the probe tip 37 supports the cord 32.

If the rotor is in an armed or partially armed position, a wiper switch on the rotor shaft is open. When the rotor is in the fully safe position, the switch is closed and will allow charge to enter the fuze electronics module.

If a fuze is charged but fails to arm because of failure to launch or because of an unreliable S&A mechanism, for example, the electric energy stored in all of the timing and firing capacitors will be discharged to ground when 12 seconds have elapsed from the time charge is introduced. If the round remains in the launch tube after its launch is attempted, it may be connected to the +24.5 Vdc charging circuit in the launcher programmer for a period greater than 12 seconds. In that event, the capacitors will discharge as soon as the voltage is removed, thus electrically sterilizing the fuze and permitting it to be reset and recharged.

In the safe and partially armed rotor positions, a wiper switch is open and the fuze capacitors are tied into a 12-second dump circuit. Only if the fuze arms before 12 seconds, thus closing this switch before dumping occurs, does the electronic logic change its state and thereby enable the firing circuits so that the first detonator will be initiated at the 12-second event.

Fifteen minutes after charging voltage is removed, the energy in each firing capacitor will have bled down through a high value resistor (7.5 megohm) to less than 5 ergs (0.24 V) which is a small fraction of the firing energy that can cause 0.1 percent of the detonators or actuators to fire (no fire energy level).

Functional Description of the Elements of the Fuze

The fuze electronic circuitry is rigidly encapsulated. Spring contacts extend from the forward and aft faces of the module to electrically connect it with the extendible probe and the S&A device, respectively. The module is fastened to the forward end of the base assembly 2.

Charging current (positive polarity) from the launcher programmer enters a capacitor energy storage network via closed contacts on the rotor safety switch to immediately power the timer and logic circuits and provide subsequent firing energy. Launcher voltage is maintained on this network until the round moves in its tube and breaks the wiring harness which is connected to the launcher. A shorted wire harness at this time does not affect the charged electronics. Energy to the controller logic, oscillator, and counter is regulated to approximately 5.6 volts, whereas the firing capacitors are charged to 24.5 Vdc by the +24.5 volts of the launcher programmer power supply.

The oscillator circuitry is governed by a shock-isolated quartz crystal which vibrates at 16 KHz. The oscillator starts when the voltage on the regulator rises to approximately 3 volts.

When the counter signals the controller that 12 seconds have elapsed, the controller signals the energy dump circuits to dump all capacitor-stored energy to ground, thus sterilizing the fuze. In the event that the fuze rotor arms before 12 seconds from charge entry have elapsed, a pair of contacts on the rotor safety switch will have closed. This signals the controller to disable the dump circuitry and enable the detonator firing control circuitry. Then, at 12 seconds, the capacitor for firing the parachute deployment detonator discharges to that detonator.

If the fuze is charged and the round is held in the launcher for more than 12 seconds (and thus +24.5 volts remain impressed on the fuze by the programmer), the dump circuit dump is held off but will operate the instant that the voltage is removed.

The controller does not accept switch closures from the probe or inertia switches to fire the cloud detonator assemblies' detonator in the fuze until 15 seconds from charge entry. At that time, the detonator firing control network is enabled. Thereafter, when the controller is signaled by either switch, it will, in turn, signal the firing network to discharge the cloud detonator assemblies' detonator. A short time later, the controller signals the firing network to discharge the burster detonator capacitor into the burster detonator.

The counter stops its operation after 15 seconds from charge entry and does not restart until the probe switch or inertia switch thereafter signals the controller. The oscillator circuit, however, operates continuously. At target switch closure, the counter restarts and counts the aforementioned short time interval.

The inertia switches are in parallel with the probe switch and each other. The inertia switches are identical; but since the sensitivity of one alone is not omnidirectional, two are required to ensure the response so either one regardless of round impact orientation. One of the two switches is oriented to be most sensitive to impacts on the front of the canister. The other is most sensitive to rearward impacts. Since the switches' axes are 90° apart on the circuit board, at least one of the two switches will respond to a lateral impact in any orientation. Although the switches are less sensitive in the lateral directions, the round's lateral impact shock is significantly greater than its axial shock.

These switches will not close for shocks less than 40 g but will close for shocks greater than 80 g along their most sensitive direction.

(1) With the rotor in the safe position, two contacts are shunted, allowing positive voltage to introduce charging current. The other contacts are open in this position, except for the BBU-24/B actuator contacts, which are shorted.

(2) When the rotor has rotated partially toward the armed position, a second set of contacts close and capacitor energy stored just prior to launch is dumped directly to the BBU-24/B actuator. This action occurs after the rotor has passed its commit-to-arm position (discussed later). At this position, the charging switch in (1) has already opened.

(3) When the rotor achieves the armed position, a third contact set closes, signaling the logic in the electronics to disable the dump circuit and connect the firing circuitry to the three detonators. Since the charging switch is open in positions (2) and (3), an inadvertently armed or partially armed fuze cannot be charged.

The rotor must rotate 80° to the armed position within 1.000 second from launch since that is the minimum programmer-selectable launch-to-parachute deployment time. The rotor arms the explosive train as follows: When the round accelerates out of the launcher, the setback weight moves aft, unlocking the rotor. The inertial force due to acceleration causes the unbalanced rotor to turn, while the escapement mechanism limits the turn speed. At rocket burnout, approximately 0.3 second from ignition, the rotor has turned approximately 20° toward the armed position and has passed a critical position (approximately 8° of rotation) which, were the setback weight to return, due to loss of acceleration, would permit the rotor to be driven back to the safe position. This critical position is termed the commit-to-arm point. Beyond this position, return of the setback weight forces the rotor ahead to the armed position. In the motor burnout phase, the acceleration falls off rapidly and the rotor slows. However, the setback weight and springs are now unloaded and the weight moves back toward its original position. In so doing, it reengages the rotor and spring-drives it the remaining arc to the armed position. In the initial spring-driven portion, the rotor turn rate is still under the control of the escapement; but at approximately 35° from the the armed position, the rotor disengages from the escapement. During the remainder of its stroke, the rotor is accelerated to the armed position within a few milliseconds, developing sufficent kinetic energy and velocity to cause the spring-loaded contact buttons attached to the Mk 96 detonators to be depressed when they simultaneously strike their stationary contact posts. The spring-driven rotor stroke consumes approximately 0.5 second, so the total arming time is therefore 0.8 second.

Returning to the inertial rotation phase, when the rotor has passed the commit point, the BBU-24/B electro-explosive actuator is fired by closure of its contacts on the switch plate. The high pressure gaseous output of the actuator is used to drive a piston away from its initial position where it blocks the rotor lobe. The piston is held in its initial position by a pin which is sheared during the piston stroke. If the actuator has not fired before the rotor lobe has turned to this position, a blind slot in the lobe will engage the piston and the rotor will be interrupted from completely arming. Even in this partially armed position, an improper detonator firing will not result in explosive initiation of the two transfer leads or Mk 8 lead. If the actuator were to unintentionally fire after the rotor had interlocked with the piston, the piston would be prevented from moving and unlocking the rotor lobe because of the presence of a locking knob on the end of the piston.

The BBU-24/B actuator is maintained in a shorted condition prior to rotor turning via grounding of its contacts on the switch plate. The Mk 96 detonators are self-shorted in the unarmed rotor position via the undepressed spring-loaded button contacts attached to the detonators. The short is removed when the buttons depress against the contact posts.

The base assembly interfaces with the front of the warhead canister and contains the Mk 8 lead for canister burster initiation. It also contains the BBU-24 actuator and piston assembly. To the base is attached the S&A device, electronics module, and fuze housing assembly.

The probe assembly is installed in the forward end of the fuze housing. It consists of a 3-inch wide, 133-inch long, spiral wound spring strip of stainless steel, capable of self-extending 65±6 inches when released, to form a rigid tube as the coils overlap into a friction-locked helix. Within the first or innermost coil is a nose element assembly which contains the target impact detecting switch and its associated spooled electric wire. It also contains a bobbin on which is wrapped a 62-inch length of 75-pound test braided nylon line. When the probe is deployed, both the wire and nylon line pay out within the forming tube. During the last several inches of deployment stroke, the nylon line runs out and gradually snubs or slows down the deployment velocity by its stretching action. Without the nylon snubbing line, the probe might overextend and have insufficient coil-to-coil overlap to provide good aerodynamic rigidity.

The impact switch in the front of the nose element may be closed in two ways upon striking a target: (1) material, such as earth or water, enters the cylindrical opening and depresses a spring-supported disc; or (2) the forward edge of the cylindrical sleeve contacts a rigid material, such as a rock, causing the sleeve to shear a preweakened internal section and slide aft. Either action causes the ground contact to touch the firing contact connected to the wire. This dual action design approach allows the extended probe to strike small branches without switch closure as the round passes through trees and shrubs, inasmuch as the branches will neither be ingested to strike the disc nor present sufficient resistance against the sleeve edge to cause the sleeve to shear.

The probe delay timer delays release of the probe for several seconds after the parachute detonator fires. It is unlocked by a tab attached to the underside of the housing cover when that cover swings open. This allows a spring-loaded sector gear to drive through a gear train which is under the control of an escapement. When the last tooth of the sector gear disengages from the gear train, the spring-driven sector engages the timer's latching tab and retracts it from engagement with the fuze housing. The probe, under the influence of its own 8-pound spring force, then propels the unlatched timer forward and out of the fuze housing as it extends.

The fuze housing cover is a flat aluminum disc containing the probe timer release tab. It hinges on one side to the fuze housing and closes over an 0-ring to seal the front of the fuze. It is held closed against the opening torque of a powerful torsion spring concentric to the hinge pin by a safety pin at the opposite end until the fuze is fastened to the round at an assembly depot. At this time, the probe cover and MDF retainer bar, for containment of the parachute-initiating MDF, is installed and takes the place of the safety pin in holding the cover in place. When the retainer bar is blown off by the MDF firing, the torsion spring swings the cover open against the restraining moment produced by frontal aerodynamic forces. When the cover has opened 180°, it unhinges and is blown off by the air flow.

What is claimed and new and desired to be secured by Letters Patent of the United States is:

1. An electronic fuze for ordnance comprising electronic means to ignite a plurality of detonators each with an explosive train lead, said detonators including at least first and second detonators to be fired sequentially each in a predetermined direction to achieve a plurality of mechanical and explosive operations, wherein each of said multiple detonators is associated with a separate explosive train operatively connected to a separate explosive means through each separate explosive train lead, and where the plurality of detonators are located in ports of a rotatable rotor and where each adjacent detonator port is oriented in a direction of fire that is different from each adjacent detonator.

2. The electronic fuze of claim 1 wherein the multiple detonators transfer three explosive charges to successively deploy braking means, operate a mechanical timer and probe release, deploy cloud detonators and detonate a burster charge.

3. The electronic fuze of claim 2 wherein the first detonator fires to operate a parachute.

4. The electronic fuze of claim 2 wherein the second detonator fires a separate explosive train lead to deploy multiple cloud detonators.

5. The electronic fuze of claim 2 wherein a third detonator fires a third separate lead to detonate a burster charge.

6. The electronic fuze of claim 1 where the longitudinal axis of one detonator is at substantially ninety degrees (90°) to the axis of the adjacent detonator.

7. The electronic fuze of claim 1 where the detonator ports are closely spaced.

8. The electronic fuze of claim 1 where the longitudinal axis of each detonator is at substantially ninety degrees (90°) to the longitudinal axis of the rotor and the longitudinal axis of each detonator is in a plane parallel to the longitudinal axis of each other detonator.

9. A method of operating an electronic time fuze comprising the steps of:

(a) remotely and quickly applying an electrical charge to an electronics module (b) arming a safing and arming device (c) transmitting electrical charge successively to three (3) detonators at separate, controlled precise times, each detonator being positioned so that two (2) adjacent detonators are oriented to point in different directions, (d) detonating in successive order the multiple detonators, (e) directing the resulting charge from each detonator through an explosive train to an operative detonating cord or detonating lead, (f) initiating the transfer of electrical charge to multiple detonators by a target sensing switch.

10. The method of claim 9 wherein step (f) is further characterized by closing the target sensing switch that in turn signals an electronics module to deliver electrical energy to a detonator and to start an electronic timer, and the said timer in turn actuates a firing device to deliver the electrical energy to the second detonator.

11. The method of claim 9 where the longitudinal axis of one detonator is at substantially ninety degrees (90°) to the axis of the adjacent detonator.

* * * * *